US007287499B2

(12) United States Patent
Lawrence et al.

(10) Patent No.: US 7,287,499 B2
(45) Date of Patent: Oct. 30, 2007

(54) CAMSHAFT ASSEMBLY

(75) Inventors: Nicholas James Lawrence, Buckingham (GB); Richard Alwyn Owen, Banbury (GB); Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 67 days.

(21) Appl. No.: 11/360,931

(22) Filed: Feb. 22, 2006

(65) Prior Publication Data

US 2006/0185471 A1 Aug. 24, 2006

(30) Foreign Application Priority Data

Feb. 23, 2005 (GB) ..... 0503700.7

(51) Int. Cl.
*F01L 1/34* (2006.01)

(52) U.S. Cl. ..... 123/90.17; 123/90.31; 123/90.27; 123/90.16; 123/90.15

(58) Field of Classification Search ..... 123/90.17, 123/90.31
See application file for complete search history.

(56) References Cited

U.S. PATENT DOCUMENTS

| | | | | |
|---|---|---|---|---|
| 4,332,222 | A * | 6/1982 | Papez | 123/90.17 |
| 5,441,021 | A | 8/1995 | Moore, II | |
| 5,664,463 | A * | 9/1997 | Amborn et al. | 74/567 |
| 6,725,817 | B2 * | 4/2004 | Methley et al. | 123/90.17 |

* cited by examiner

*Primary Examiner*—Thomas Denion
*Assistant Examiner*—Kyle M. Riddle
(74) *Attorney, Agent, or Firm*—Smith-Hill and Bedell

(57) ABSTRACT

A camshaft assembly comprises an inner shaft 12 and an outer tube 14 surrounding and rotatable relative to the inner shaft. Two groups of cam lobes are mounted on the outer tube 14 , the first group of cam lobes 16 being fast in rotation with the outer tube 14 and the second group of lobes 26 being rotatably mounted on the outer surface of the tube 14 and connected for rotation with the inner shaft by means of pins 22 that pass with clearance through slots in the outer tube 14 . A sleeve 20 rotatably mounted on the outer tube 14 is connected to impart drive to the inner shaft 12 by means of a pin 24 passing with clearance through a circumferentially extending slot in the outer tube 14.

13 Claims, 2 Drawing Sheets

CAMSHAFT ASSEMBLY

Figure 1:
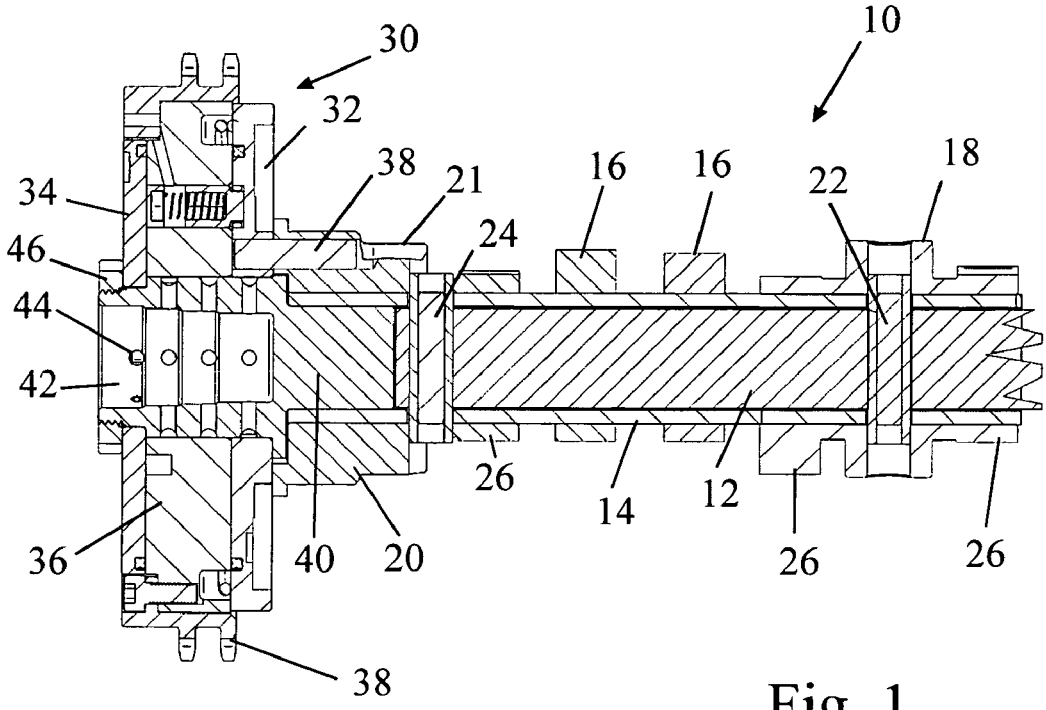

This application claims priority under 35 USC 119 of United Kingdom Patent Application No. 0503700.7 filed Feb. 23, 2005.

The present invention relates to a camshaft assembly and to an engine fitted with a camshaft assembly. The invention is particularly applicable to engines with SCP camshafts that have large support bearings and which are designed to be assembled to the engine from one end of a bearing bore in the cylinder block or cylinder head.

Camshaft assemblies are known which comprise an inner shaft and an outer tube surrounding and rotatable relative to the inner shaft. Two groups of cam lobes are mounted on the outer tube, the first group of cam lobes being fast in rotation with the outer tube and the second group being rotatably mounted on the outer surface of the tube and driven by the inner shaft by way of pins that pass with clearance through circumferentially extending slots in the outer tube. This type of camshaft assembly is termed an SCP (Single Camshaft Phaser) camshaft because it enables the relative phase of valves operated by cam lobes on the same camshaft to be varied.

Many different designs of SCP camshaft are known from the prior art and each requires a method for driving the camshaft from the crankshaft and for introducing a phase shift in the timing of the outer tube and/or the inner shaft.

Various designs of a phase change mechanism, also termed a phaser, are known which have two concentric output members. The phase of the output members of the phaser can be varied by rotating them relative to one another and in some phaser designs the phase of both output members can be varied relative to the engine crankshaft. The conventional approach to coupling the two concentric output members of a phaser to the concentric inner shaft and outer tube of an SCP camshaft is to couple the inner shaft to the inner of the two phaser output members and the outer tube of the SCP camshaft to the outer of the two output members of the phaser. Difficulty arises in this approach in establishing a secure coupling between the outer output member of the phaser and the end of the outer tube of the SCP camshaft.

According to the present invention, there is provided a camshaft assembly comprising an inner shaft, an outer tube surrounding and rotatable relative to the inner shaft, a first group of cam lobes mounted on the outer tube and fast in rotation with the outer tube, a second group of cam lobes rotatably mounted on the outer surface of the tube, circumferentially extending slots in the outer tube, pins projecting from the inner shaft and passing with clearance through the circumferentially extending slots in the outer tube to engage and drive the second group of cam lobes, and a sleeve rotatably mounted on the outer tube, the sleeve being connected to impart drive to the inner shaft by means of a pin passing with clearance through a circumferentially extending slot in the outer tube.

The present invention elegantly circumvents the difficulty encountered in the prior art by enabling the connections between the output members of the phaser and the SCP camshaft to be reversed. In the invention, the outer of the phaser output members may be connected to the inner shaft of the camshaft by making use of the sleeve that is rotatable relative to the outer tube.

U.S. Pat. No. 5,441,021 describes an assembled camshaft in which the phase of cams rotatably mounted on an outer tube is varied by means of an axially displaceable inner shaft. Pins which project radially from the inner shaft through axially extending slots in the outer tube engage in helical grooves in the inner surface of the cams. The radial pins cause the cams to rotate relative to the outer tube in response to axial displacement of the inner shaft. In the latter patent, the inner shaft is driven axially by means of a pin which engages in a sleeve slidable relative to the outer tube, the sleeve being itself moved axially in response to radial movement of centrifugal weights.

Such a mechanism differs fundamentally from the present invention because the inner shaft is not required to transmit the torque needed for opening and closing the engine valves.

In the preferred embodiment of the present invention, the sleeve is a bearing sleeve which is also used to support the camshaft in a pillar block. Conventionally, the bearing sleeve of an SCP camshaft is fast in rotation with the outer tube of the camshaft but in the preferred embodiment of the present invention it is allowed to rotate about the outer tube and is connected by a pin passing with clearance through a slot in the outer tube to impart drive to the inner shaft of the camshaft.

As the connection between the inner shaft and the phaser no longer lies on the axis of the camshaft, it is possible to provide a drive coupling between the inner output member of the phaser and the outer tube of the camshaft which engages inside an end of the outer tube that extends forward of the end of the inner shaft.

The camshaft outer tube may thus conveniently be driven via a fixed insert permanently joined to the front end of the outer tube which supports the camshaft phaser and contains the necessary oil passages for controlling the camshaft phaser. As an alternative, the camshaft tube can be fitted with a threaded insert which allows the phaser to be connected to it via a central fixing bolt.

This design lends itself to having all the cam lobes that are rotatably mounted on the outer tube connected to bearing sleeves of the camshaft, as this allows a single connecting pin to rotate a group of cam lobes and bearings. As these rotating components can be expensive to manufacture from a single piece of material, they are produced in the preferred embodiment of the invention as composites made up from a number of separately formed simple parts that are assembled to one another.

Any SCP camshaft design must provide adequate control of the axial position of the inner drive shaft relative to the camshaft tube. In a preferred embodiment of the invention, a self retaining fastener in the bore of the camshaft outer tube is used to achieve this objective in a simple and cost effective manner.

Figure 2:
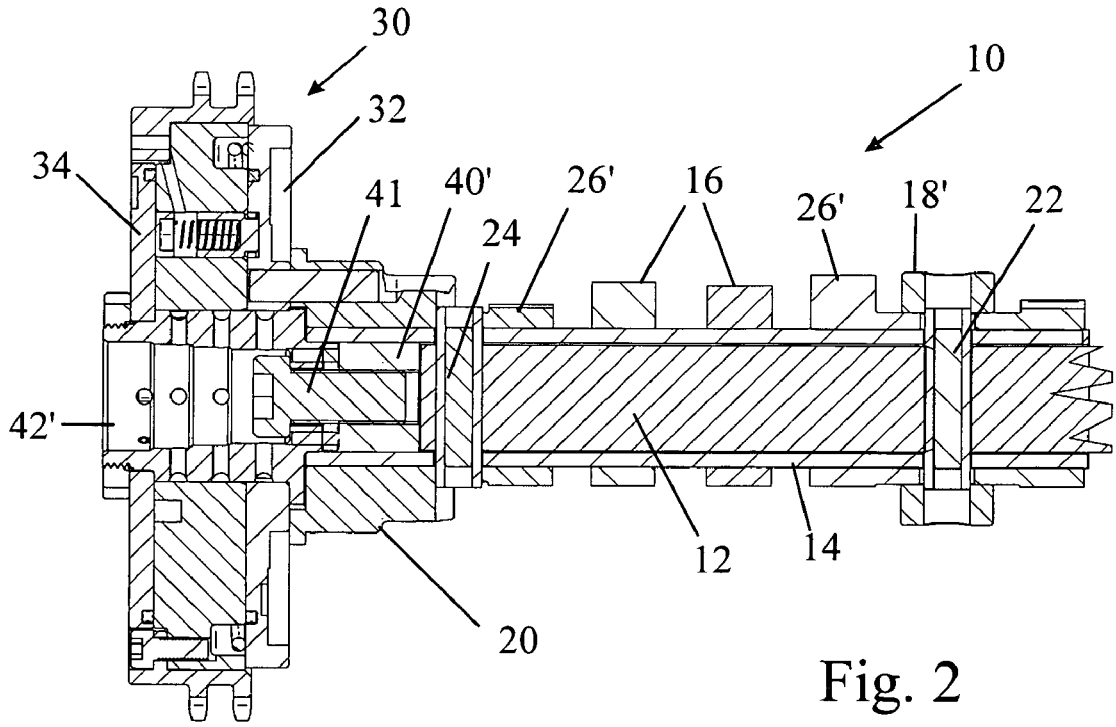
Figure 3:
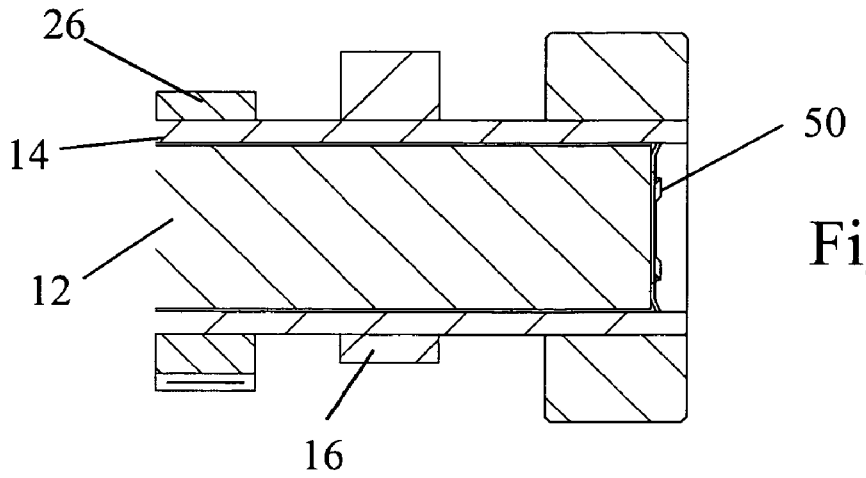
Figure 4B:
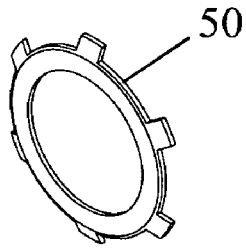
Figure 4A:
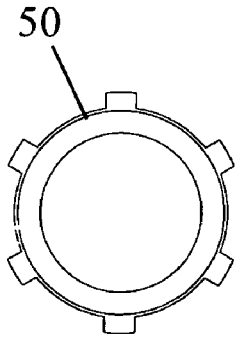
Figure 5:
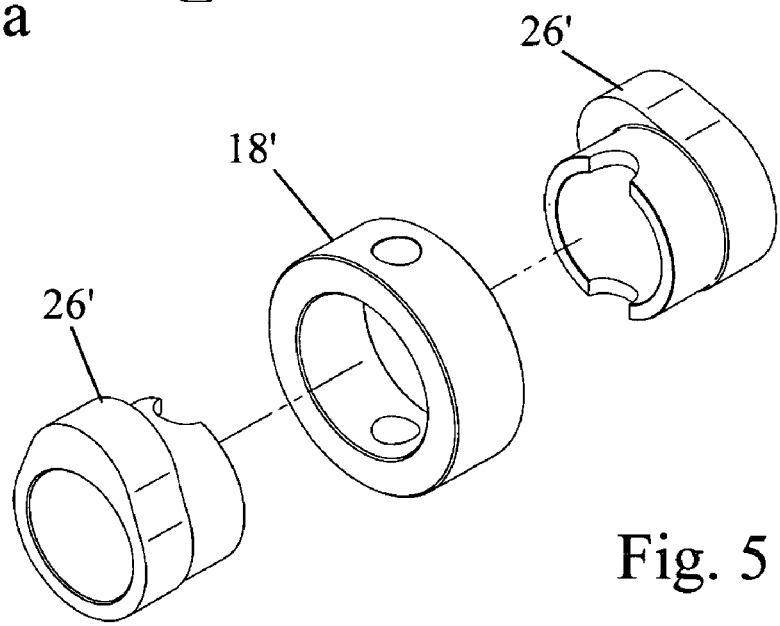

The invention will now be described further, by way of example, with reference to the accompanying drawings, in which:

FIG. 1 is a section through a phaser and part of a camshaft of a first embodiment of the invention, FIG. 2 is similar section showing an alternative embodiment of the invention, FIG. 3 is a section through the opposite ends of the camshafts shown in FIG. 1 and FIG. 2, FIGS. 4*a* 4*b* are respectively a plan view and a perspective view of the self-retaining spring fastener of FIG. 3, and FIG. 5 is an exploded perspective view of a bearing sleeve and two adjacent cam lobes.

In FIG. 1, an SCP camshaft 10 comprises an inner shaft 12 and an outer tube 14. Cam lobes 16 are secured for rotation with the outer tube 14. Sleeves 18 and 20, which act as bearing sleeves for supporting the camshaft 10 in pillar blocks in the engine, are rotatably mounted on the outer tube 14 and are fixed in rotation with the inner shaft 12 by means of pins 22 and 24 which pass with clearance through tangentially elongated slots in the outer tube 14. In this way the bearing sleeves 18 and 20 are afforded a limited degree of rotation relative to the outer tube 14.

The sleeve 20 is formed integrally with a cam lobe 26 which rotates with the inner shaft 12. Similarly, the sleeve 18 is formed integrally with two further cam lobes 26 that rotate with the inner shaft 12. In this way, when the inner shaft rotates relative to the outer tube 14 the phase of the cam lobes 16 is varied in relation to the phase of the cam lobes 26. The sleeve 20 also has a notch 21 which forms part of a sensor to determine the angular position of the inner shaft 12.

A phaser 30 is fixed to the left hand end as viewed of the camshaft 10. The phaser 30 is a hydraulically operated vane-type phaser which is itself known and does not need to be described in detail in the present context. The phaser 30 has arcuate cavities formed in a stator 36 having sprocket teeth 38 and driven by the engine crankshaft. Two end plates 32 and 34 arranged on opposite sides of the stator 36, which act as output members, are connected to radial vanes that are received in the arcuate cavities to form arcuate working chambers. By controlling the supply of hydraulic fluid to the working chambers, each of the two output members 32 and 34 can be rotated relative to the stator 36. The phaser has a hub 42 that is clamped by means of a nut 46 for rotation with the output member 34. The hub 42 is also formed with passages 44 through which fluid is supplied to and drained from the working chambers of the phaser 30. In use, a connector plug (not shown), which forms part of an engine cover, is used to connect the phaser to a control valve that controls the phasing of the engine valves. Because there are two separate hydraulic circuits, the phase of the each of the output members 32 and 34 can be controlled separately in relation to the engine crankshaft.

The output member 32 is connected to the sleeve 20 by means of a pin 38 and it used to drive the inner shaft 12 through the pin 24. The outer tube 14, on the other hand, receives an insert 40 that is formed integrally with the hub 42 and is in this way rotated by the output member 34. This is the exact opposite of the conventional approach of using the hub 42 to drive the inner shaft 12 and the output member 32 to drive the outer tube 14.

The inner shaft 12 is prevented from moving to the left, as viewed in FIG. 1 by abutment with the insert 40. To prevent it from moving to the right, as viewed, a self retaining spring fastener 50 is inserted into the opposite end of the outer tube 14 as shown in FIG. 3, the fastener itself being shown more clearly in FIGS. 4*a* and 4*b*.

The embodiment of FIG. 2 is generally similar to that of FIG. 1 and like reference numerals have been used for like components. Where components have been modified, a prime has been added to the reference numeral. The two embodiments differ in only two respects. First, the hub 42' and the insert 40' are formed separately from one another and secured to one another by means of a bolt 41. Second, instead of the bearing sleeves 18, 20 being formed integrally with the adjacent cam lobes 26, bearing sleeves 18', 20' are formed separately from the cam lobes 26' and are assembled with one another. In the arrangement shown in FIG. 5, the cam lobes 26' are an interference fit in the bearing sleeve 18', the semi-circular cut-outs being sufficient large to allow the pin 22 to pass through unhindered. As an alternative, the sleeves 18' and the cam lobes 26' may be welded or brazed to one another or screw threaded into each other.

The described embodiments of the invention offer the following advantages when compared with existing designs:

The phaser and the forces from the chain/belt drive from the crankshaft are supported by the camshaft tube, rather than the inner drive shaft.

The inner drive shaft does not have any radial forces applied to it by any of the SCP camshaft components, which removes the need for accurate location bearings for the shaft inside the tube.

The lack of bearings allows the component tolerances to be relaxed because the moving cam sections only rely on the drive shaft for their angular position.

The axial location of the inner shaft can be achieved via a simple and cost effective method.

The combination of moving cam lobes with the camshaft bearings has the possibility for increasing the length of engagement of the connecting pins due to the large diameter of the bearing sleeves.

The possibility for producing the moving sections as a composite offers the possibility of a reduced manufacturing cost.

The positioning of the slots in the outer tube under the camshaft bearings increases the bending stiffness of the camshaft because the unsupported sections are free from any slots.

The invention claimed is:

1. A camshaft assembly comprising an inner shaft, an outer tube surrounding and rotatable relative to the inner shaft, a first group of cam lobes mounted on the outer tube and fast in rotation with the outer tube, a second group of cam lobes rotatably mounted on the outer surface of the tube, circumferentially extending slots in the outer tube, pins projecting from the inner shaft and passing with clearance through the circumferentially extending slots in the outer tube to engage and drive the second group of cam lobes, and a sleeve rotatably mounted on the outer tube, the sleeve being connected to impart drive to the inner shaft by means of a pin passing with clearance through a circumferentially extending slot in the outer tube.

2. In combination, a camshaft assembly and a phaser for connecting the camshaft assembly to an engine crankshaft, wherein the camshaft assembly comprises an inner shaft, an outer tube surrounding and rotatable relative to the inner shaft, a first group of cam lobes mounted on the outer tube and fast in rotation with the outer tube, a second group of cam lobes rotatably mounted on the outer surface of the tube, circumferentially extending slots in the outer tube, pins projecting from the inner shaft and passing with clearance through the circumferentially extending slots in the outer tube to engage and drive the second group of cam lobes, and a sleeve rotatably mounted on the outer tube, the sleeve being connected to impart drive to the inner shaft by means of a pin passing with clearance through a circumferentially extending slot in the outer tube, and wherein the phaser has concentric inner and outer output elements connected to the camshaft assembly to enable the phase of the inner shaft and outer tube of the camshaft assembly to be varied dynamically relative one another, the inner shaft of the camshaft assembly being coupled to outer output element of the phaser by way of the sleeve.

3. A combination as claimed in claim 2, wherein the sleeve driving the inner shaft of the camshaft assembly acts as a bearing sleeve for supporting the camshaft assembly in a pillar block in an engine.

4. A combination as claimed in claim 2, wherein the outer tube is driven via an insert fixed within one end of the tube (14).

5. A combination as claimed in claim 4, wherein axial movement of the inner shaft relative to the outer tube is limited in one direction by the insert and in the opposite direction by a self retaining fastener mounted into the opposite end of the outer tube.

6. A combination as claimed in claim 4, wherein the fixed insert serves as a mounting for the phaser.

7. A combination as claimed in claim 6, wherein the phaser is hydraulically operated and the fixed insert incorporates oil passages for controlling the motion of the phaser.

8. A combination as claimed claim 2, wherein all the cam lobes that are fast in rotation with the inner shaft of the camshaft assembly are formed integrally with bearing sleeves for supporting the camshaft assembly in an engine.

9. A combination as claimed in claim 2, wherein all the cam lobes that are fast in rotation with the inner shaft of the camshaft assembly are formed as a composite assembly with bearing sleeves for supporting the camshaft assembly in an engine.

10. A combination as claimed in claim 9, wherein each cam lobe is an interference with a bearing sleeve.

11. A combination as claimed in claim 9, wherein the cam lobes and bearing sleeves are welded or brazed to one another.

12. A combination as claimed in claim 9, wherein the cam lobes and bearing sleeves are assembled to one another by means of a screw thread.

13. A combination as claimed in claim 2, wherein a sleeve that rotates with the inner shaft of the camshaft assembly is formed integrally with a timing pickup for a sensor to determine the phase of the inner shaft during operation.

* * * * *